United States Patent [19]

Hiratsuka et al.

[11] 4,183,683

[45] Jan. 15, 1980

[54] LINE PRINTER FOR THE RAISED-DOT LANGUAGE OF BRAILLE CHARACTERS

[75] Inventors: Shoichi Hiratsuka, Narashino; Hideki Arai, Tokyo, both of Japan

[73] Assignee: Tokyo Metropolitan Government, Tokyo, Japan

[21] Appl. No.: 891,225

[22] Filed: Mar. 29, 1978

[51] Int. Cl.[2] ..... B41J 3/32

[52] U.S. Cl. ..... 400/122; 101/18; 400/649

[58] Field of Search ..... 101/18, 28, 297; 400/122, 649, 658

[56] References Cited

U.S. PATENT DOCUMENTS 3,280,739 10/1966 Hu ..... 101/297

FOREIGN PATENT DOCUMENTS 14143 9/1934 Australia ..... 101/28

2364342 6/1975 Fed. Rep. of Germany ..... 400/122

*Primary Examiner*—Paul T. Sewell

*Attorney, Agent, or Firm*—Fleit & Jacobson

[57] ABSTRACT

A printing mechanism of a line printer for printing Braille characters is disclosed. The printing mechanism comprises a base member having a plurality of printing pins arranged in a row and adapted to be prevented from moving downward in response to the energization of solenoids corresponding to character patterns to be printed, a semicircular printing plate for pressing a paper against the printing pins and a printing plate driving mechanism. During every printing operation, the printing plate is rocked in a lengthwise direction by a pair of rotating disks provided at the ends of the printing plate and each including an eccentric cam groove different in phase with each other, so that the paper is successively pressed against the printing pins in the direction of their arrangement and the raised dots are produced. In another embodiment of the invention, the printing plate is operated by a pair of piston-crank mechanisms provided at the ends of the printing plate.

8 Claims, 11 Drawing Figures

LINE PRINTER FOR THE RAISED-DOT LANGUAGE OF BRAILLE CHARACTERS

BACKGROUND OF THE INVENTION

The present invention relates to line printers for printing raised-dot language known as the Braille characters, and more particularly the invention relates to a printing mechanism for line printers of the type in which a paper is pressed against a plurality of printing pins projected in accordance with the character patterns to be printed so as to produce the desired raised dots.

Recently, the use of a computer system has been introduced as a means of translating into the Braille characters which are known as a means of communication for the blind, and consequently it is now possible to make books written in Braille characters available for the blind by automatically converting the contents of books into Braille character code, recording them on cassette tapes or the like and keeping these tapes in libraries for blind, educational institutions, etc., in various districts for reproduction in case of need. The similar situation is prevalent in all the countries where any of the raised-dot languages for the blind including the Braille characters is used.

To reproduce the Braille character code which is recorded on a cassette tape, it is desirable to use a line printer for increasing the printing speed. However, the development of line printers intended for exclusive use on the Braille characters has been slow, and consequently the line printer used in the ordinary computer system has been modified and used for printing raised dots on a paper. As a result, the line printer is expensive, and moreover the use of the ordinary line printer results in a complicated mechanism. In particular, the use of hammers for producing embossed dots requires a considerably large drive source and this also causes considerable noise.

SUMMARY OF THE INVENTION

Therefore, it is an object of the present invention to provide a line printer for exclusive use on raised dot language which does not use any conventional mechanism including hammers for producing embossed dots but employs a mechanism which produces embossed dots by pressing a paper form against the printing pins.

It is another object of the invention to provide a printing mechanism for such line printer which includes a semicircular printing plate designed so that embossed dots are produced by pressing against a plurality of dot pins projected in accordance with a Braille character code a paper form successively in the direction of arrangement of the pins, thus making it possible to operate the printing mechanism with a small drive source and practically eliminating the occurrence of noise during printing operation.

It is still another object of the invention to provide a line printer including a driving mechanism having a pair of rotating disks each provided with an eccentric cam groove which are different in phase with each other so as to produce a movement which successively presses the printing plate against a plurality of dot pins in the direction of arrangement of the pins during a single operation.

It is still another object of the invention to provide a line printer including a driving mechanism having a pair of piston-crank mechanisms which are different in phase with each other for moving the printing plate in response to the movement of the pistons of the driving mechanism.

These and other objects, advantages, features and uses will become more apparent as the description proceeds, when considered with the accompanying drawings.

DESCRIPTION OF THE PREFERRED EMBODIMENTS

As is well known in the art, the Braille characters are such that the braille alphabets are represented by dot patterns formed by arranging in different positions and combinations the raised dots of a 6-dot cell arranged in two vertical rows of three high and two wide. Braille as officially approved in the United States includes several grades, i.e., Grade I Braille which provides full spelling of words, Grade II Braille which consists of Grade I Braille plus contractions in short form words and Grade III Braille which is an extension of Grade II Braille. The line printer of this invention is designed so that embossed dots representing Braille characters are printed on a paper form from the reproduced output of a cassette tape having the Braille characters recorded in code form.

Figure 1:
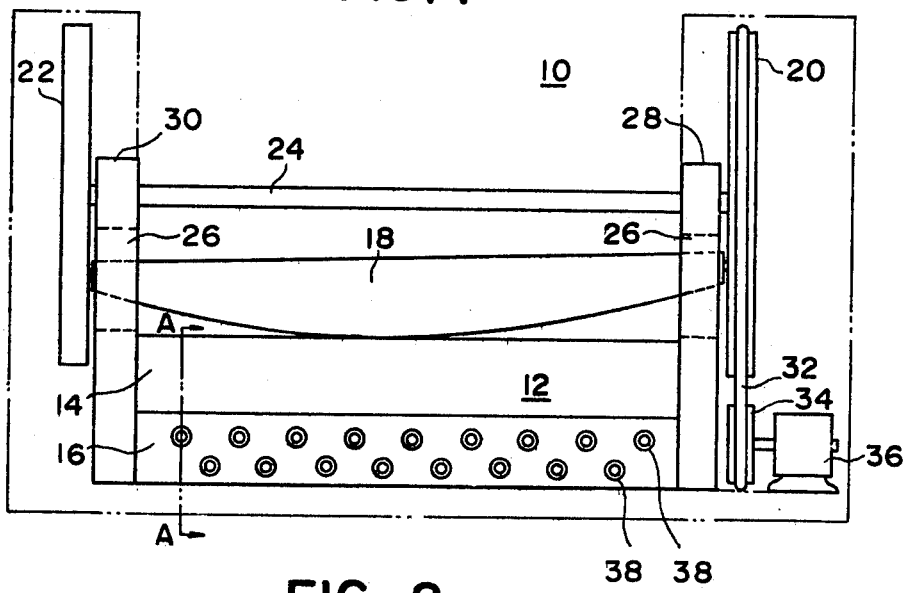
FIG. 1 is a front view of a line printer mechanism according to the present invention.
Figure 2:
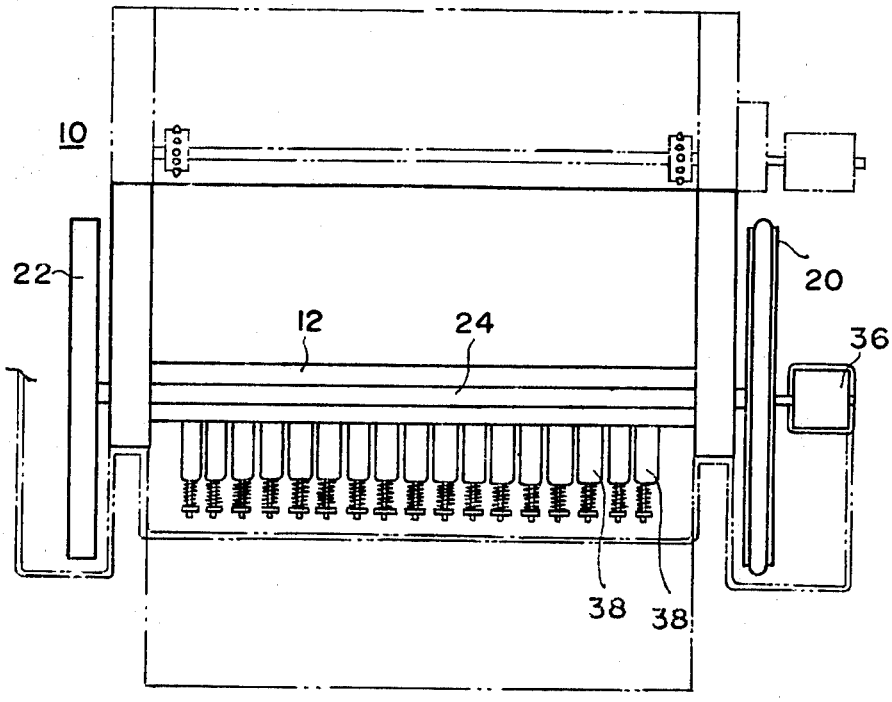
FIG. 2 is a plan view of the line printer mechanism of this invention.

Referring now to FIGS. 1 and 2, a line printer 10 according to the invention comprises a base member 12 divided into upper and lower structural members 14 and 16, a semicircular printing plate 18 adapted to successively press the upper surface of the base member 12 from one side to the other side thereof, a pair of rotating disks 20 and 22 which are each formed with an eccentric cam groove so as to vertically rock the printing plate 18 in such a manner that one end of the printing plate 18 is rocked with a predetermined amount of delay in relation to the other end, a rotary shaft 24 fixed to the rotating disks 20 and 22, a pair of side wall plates 28 and 30 supporting the shaft 24 and each having a slit 26 adapted to restrain the movement of the printing plate 18 only in a lengthwise direction and a motor 36 constituting a driving source for rotating a pulley 34 to a rotary motion to the rotating disk 20 through a belt 32 extended around the disk 20.

Figure 4:
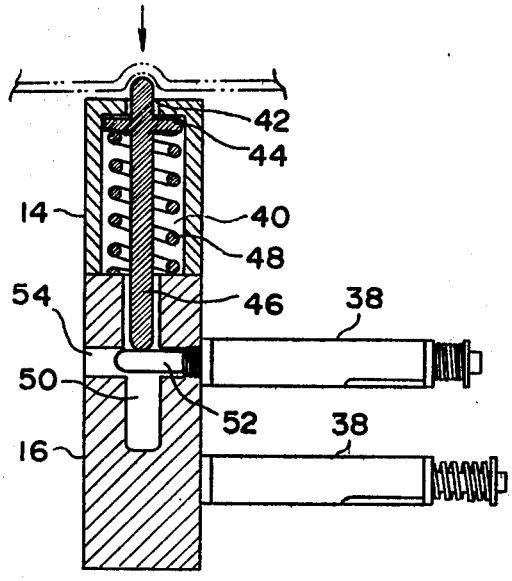
FIG. 4 is an enlarged sectional view taken along the line A–A of FIG. 1, showing the base member used in the line printer mechanism of this invention.

A plurality of solenoids 38 are mounted in two rows on the lower structural member 16 of the base member 12, and the solenoids 38 can be electrically energized in response to the Braille character code reproduced from a cassette tape. The details of the base member 12 will be seen from the enlarged sectional view of FIG. 4, in which the structural member 14 is provided therein with a plurality of cavities 40 each having a pin hole 42, and disposed in each cavity 40 is a printing pin 46 having a collar 44 and upwardly biased by a coiled spring 48. On the other hand, the lower structural member 16 is provided with guide holes 50 for the printing pins 46, and formed across each guide hole 50 is a transverse guide hole 54 for receiving a latch pin 52 adapted to be projected by the electrical energization of the solenoid 38 which is threadedly fitted in one end of the guide hole 54. In the illustrated conditions, the upper solenoid 38 has been electrically energized so that the latch pin 52 is extending across the guide hole 50 and the lower end of the printing pin 46 is locked in place by the latch pin 52. Consequently, when the paper is pressed against the head of the printing pin 46, the printing pin 46 will be prevented from being depressed, thus producing an embossed dot.

A plurality of the pins 42 each adapted to be prevented from being pressed down by the energization of the solenoid 38 and corresponding in number to a predetermined number of characters, are arranged in a traverse row in the base member 12 with their hands being projected therefrom.

Figure 3:
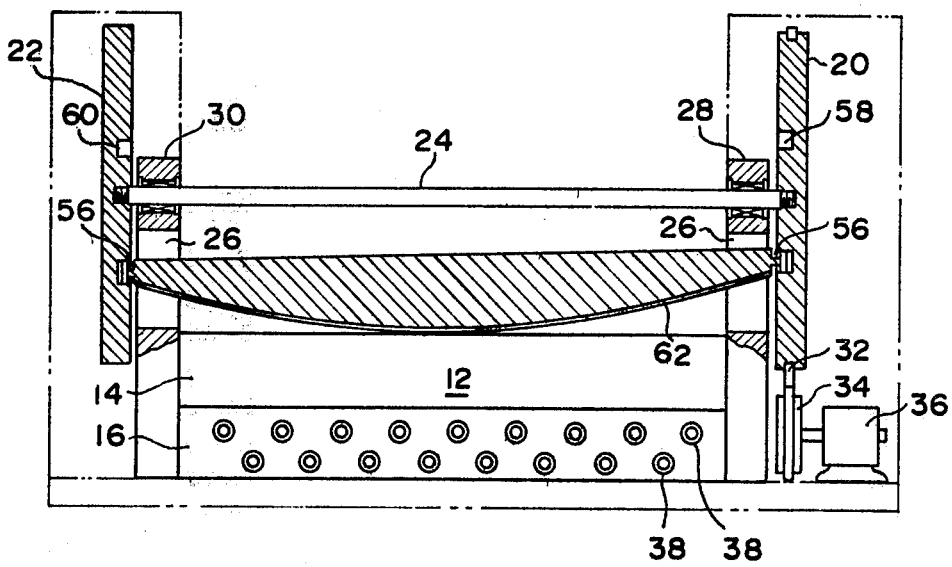
FIG. 3 is a partial sectional view of the printing plate driving mechanism used in the line printer mechanism of this invention.

The printing plate 18 for pressing the paper form against the printing pins arranged in a row in the upper surface of the base member 12 to produce embossed dots, will now be described in detail with reference to the partial sectional view of FIG. 3. In the Figure, the lower surface of the printing plate 18 is in the form of a segment of a circle having a predetermined radius, and the printing plate 18 is provided at its side ends with a pair of guide rollers 56 which are received in eccentric cam grooves 58 and 60 of the rotating disks 20 and 22 through the slits 26 formed in the side wall plates 28 and 30. The printing plate 18 is provided in the lower surface thereof with a groove 62 for receiving the heads of the printing pins 46.

Figure 9:
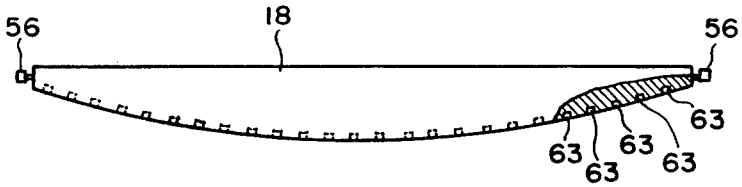
FIG. 9 is a partial sectional view showing another form of the printing plate having a plurality of receiving holes.

Alternatively, the printing plate 18 may be provided in its lower surface with a plurality of pin head receiving holes 63 as shown in FIG. 9.

Figure 5:
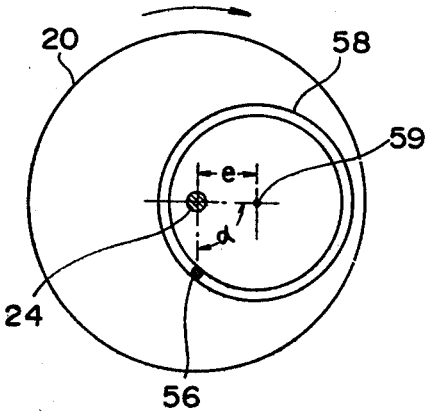
FIG. 5 is a diagram showing one of the pair of rotating disks used in the driving mechanism of this invention and having an eccentric cam groove formed in its inner surface.
Figure 6:
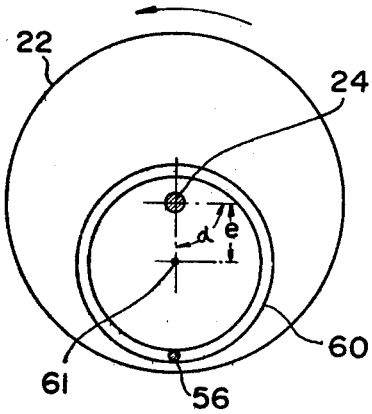
FIG. 6 is a diagram showing the other of the pair of rotating disks used in the driving mechanism of this invention and having an eccentric cam groove in its inner surface.

Now referring to FIGS. 5 and 6, there are illustrated the rotating disks 20 and 22 respectively having the eccentric cam grooves 58 and 60 whose centers 59 and 61 have an eccentricity (e) with respect to the rotary shaft 24, and the eccentric cam groove 60 is formed so that its center 61 has a rotational angular difference ($\alpha$) of $\pi/2$ with respect to the center 59 of the eccentric cam groove 58. It is to be noted that the rotational angular difference ($\alpha$) may assume any given value in the range between 0° and 180°.

Figure 7:
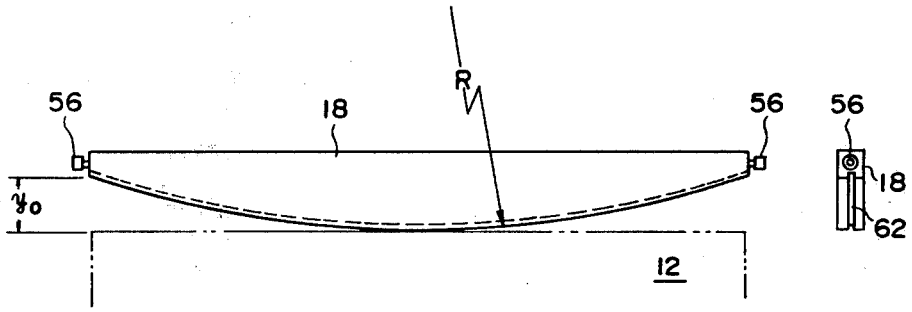
FIG. 7 is a diagram showing the shape and dimensions of the printing plate used in the line printer mechanism of this invention.

FIG. 7 illustrates the shape and dimensions of the printing plate 18 whose lower surface is in the form of a segment of a circle ith a radius (R), and (Yo) represents the distance of the upper surface of the base member 12 or the lower end of the printing plate 18 in a horizontal position from the position of the printing plate 18 where the circumference ends.

Figure 8:
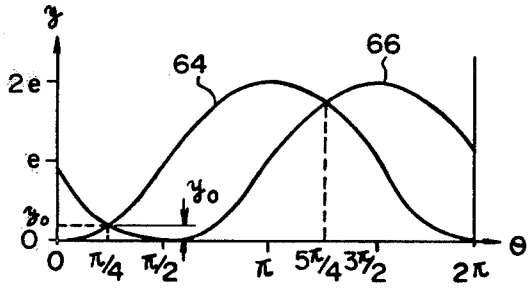
FIG. 8 is a displacement diagram of circular disk cam showing the movement of the ends of the printing plate effected by the pair of rotating disks whose eccentric cam grooves are different in phase with each other by $\pi/2$.

FIG. 8 is a displacement diagram in which the ordinate represents the displacement (Y) of the rollers 56 of the printing plate 18 and the abscissa represents the rotational angle $\theta$ when the rotational angular difference between the eccentric cam grooves 58 and 60 of the rotating disks 20 and 22 is $\pi/2$. The curve 64 indicates the displacement of the guide roller 56 by the eccentric cam groove 58 of the rotating disk 20 shown in FIG. 5, and the curve 66 indicates the displacement of the guide roller 56 by the eccentric cam groove 60 of the rotary disk 22 shown in FIG. 6.

Now referring to FIGS. 5, 6, 7 and 8, the relationship between the eccentricity (e) of the eccentric cam grooves 58 and 60 and the height (Yo) of the arcuate portion of the printing plate 18 in a horizontal position will now be described. In this connection, the displacement (Y1) of the curve 64 and the displacement (Y2) of the curve 66 in FIG. 8 are given as $$Y_1 = e(1-\cos\theta) \quad (1)$$

$$Y_2 = e\{1-\cos(\theta-\alpha)\} \quad (2)$$

where e=the amount of eccentricity of the eccentric cam groove with respect to the center of rotation, $\theta$=the rotational angle, and $\alpha$=the rotational angular difference (phase difference) between the eccentric cam grooves.

In this case, while the printing plate 18 is brought into a horizontal position when $Y_1=Y_2$ and the horizontal position of FIG. 7 is obtainable at $\theta=\pi/4$ or $\theta=5\pi/4$ in FIG. 8, the lower surface of the printing plate 18 must be in contact with the upper surface of the base member 12 and therefore FIG. 7 represents the condition at $\theta=\pi/4$.

Thus, substituting $\theta=\pi/4$ into the above equation (1) or (2), the following relation holds $$Y_1 = Y_2 = Y_0 = e(2-\cos\pi/4) \quad (3)$$

The above equation (3) can be generally given in terms of the phase difference ($\alpha$), as follows $$Y_0 = e\{1-\cos(\alpha/2)\} \quad (4)$$

When the number of Braille characters to be printed in a single operation is determined, the relationship of the above equation (4) may be used in obtaining the required dimensions of the printing plate 18 and the required eccentricity (e) of the eccentric cam grooves 58 and 60 of the rotating disks 20 and 22.

As for example, assume that it is desired to emboss the dots corresponding to 50 Braille characters in a row at a time. Since, as is well known in the art, the horizontal space between the dots in each Braille character is 0.92 inches and the space between the characters is 0.92 inches, the base plate 12 having 100 printing pins arranged over the length of 92 inches is used to print 50 characters. As a result, in order to ensure pressing of 100 printing pins corresponding to 50 characters, the length (l) of the circumferential portion of the printing plate 18 must be 92 inches. The radius R of the circle which provides the required circumferential length of the printing plate 18, i.e., l=92 inches, must be determined under the following conditions in order to minimize the traverse movement of the guide rollers 56 mounted on the ends of the printing plate 18:

$$R \geqq (4l/\pi)$$

Following the determination of R under the above conditions, the value of $Y_0$ in FIG. 7 is obtained from the following equation:

$$Y_0 = R\{1-\cos(l/2R)\}$$

By substituting this $Y_0$ into the equation (4), the eccentricity (e) of the eccentric cam grooves 58 and 60 with respect to the axis of rotation is obtained.

As will be seen from the displacement diagram of FIG. 8, with the phase difference $\alpha=\pi/2$, the printing plate 18 is brought into operation to press the paper against the printing pins on the base member 12 in the direction of the arrangement thereof during the rotational angle $\theta=0$ to $\pi/2$, and during the remaining $\theta=\pi/2$ to $2\pi$the printing plate 18 is lifted and brought out of contact with the base member 12, thus permitting the feeding of the paper form to prepare for the next printing operation. To provide for paper feed control, it is only necessary to mount a light shielding plate on either the rotating disk 20 or 22 in such a manner that a photoelectric detecting element is brought into operation by detecting a suitable rotational position after a ¼ revolution of the rotating disk from the start of the printing and then a stepping motor is brought into operation in response to an output of the photoelectric detecting element to feed the paper form.

Figure 10:
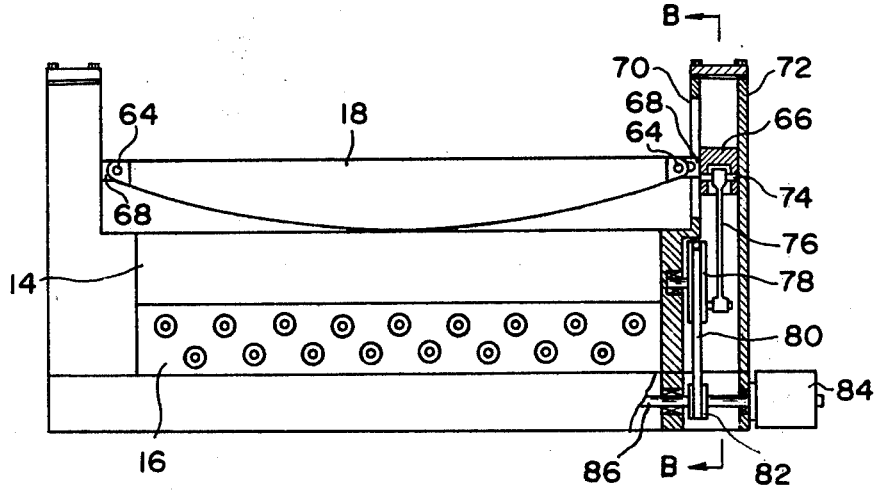
FIG. 10 is a partial sectional view showing another form of the printing plate driving mechanism employing a pair of piston-crank mechanisms.
Figure 11:
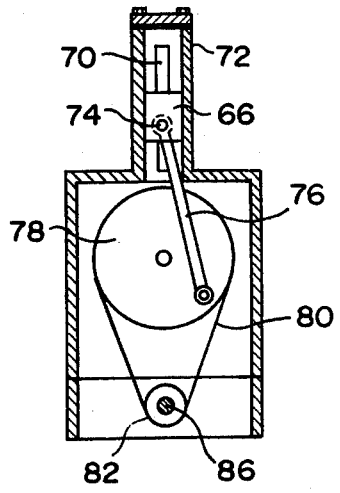
FIG. 11 is a side view of the piston-crank mechanism taken along the line B—B of FIG. 10.

Referring now to FIGS. 10 and 11, there is illustrated another embodiment of the invention which differs from the first embodiment in that the driving mechanism of the printing plate 18 comprises a pair of piston-crank mechanisms. Each side end of the printing plate 18 is fitted by a pin 64 in the sliding groove of a coupling member 68 projected from a piston 66, and the piston 66 slides vertically within a cylinder 72 formed in its inner side with a vertical slit 70. The piston 66 is connected to a crank arm 76 by a pin 74, and the lower end of the crank arm 76 is eccentrically connected to a rotating disk 78. A belt 80 is extended over the rotating disk 78 and a pulley 82, and the belt 80 is moved through the rotation of a motor 84. The rotary motion of the motor 84 is transmitted by a shaft 86 to a similar piston-crank mechanism on the left side.

The crank arm 76 is connected to the rotating disk 78 in such a manner that the connecting position of the crank arm 76 has a rotational angular difference ($\alpha$) with respect to the connecting position of the crank arm in the left side piston-crank mechanism, thus providing the same rocking movement of the printing plate 18 as the eccentric cam grooves of the previously described first embodiment. By virtue of these piston-crank mechanisms, the line printer according to the second embodiment of this invention has the advantage of ensuring increased printing speed.

It will thus be seen from the foregoing description that by virtue of the fact that the moving mechanism, such as, hammers of the prior art printer is replaced with a semicircular printing plate which is rocked to press a paper form against the dot pins and thereby to produce embossed dots constituting Braille characters, the line printer according to the present invention has the advantage of greatly simplifying the printing mechanism, reducing the power requirement of the driving source, and practically eliminating the occurrence of noise by the embossing operation.

What is claimed is:

1. A line printer for printing raised-dot language comprising:

(1) a base member having in an upper structure thereof a row of a plurality of printing pins, and means for biasing said pins so that heads of said pins protrude above a surface of said base member, and having in a lower structure thereof a plurality of latch pins and a plurality of solenoids energizable to protrude said latch pins into positions in which they prevent the printing pins from being depressed;

(2) a printing plate member for pressing a paper form against the heads of said plurality of printing pins arranged on said base member sequentially from one end to the other end thereof in the direction of arrangement of said printing pins so as to produce embossed dots on the paper form, and (3) a driving mechanism disposed to be operated from a driving source such that said printing plate member is moved like a cradle in the direction of arrangement of said printing pins, said driving mechanism comprises:

a pair of side wall plates attached to the sides of said base member and each having a vertical slit for guiding the sides of said printing plate member;

a pair of rotating disks fixedly mounted on a rotary shaft extended through said side plates, each of said rotating disks being provided in the inner surface thereof with an eccentric cam groove in such a manner that one of said eccentric cam grooves has a predetermined rotational angular difference with respect to the other; and means for transmitting a rotary motion from said driving source to one of said pair of rotating disks.

2. A line printer according to claim 1, wherein said printing plate member comprises a semicircular plate including a surface adapted to be pressed against said base member, said surface being in the form of a circular surface forming a part of a circumference of a circle having a predetermined radius, and coupling means provided at each side end of said plate to transmit thereto a rocking motion from said driving mechanism.

3. A line printer according to claim 2, wherein said circular surface of said semicircular plate is provided with a longitudinal groove for receiving the heads of said printing pins.

4. A line printer according to claim 2, wherein said circular surface of said semicircular plate is provided with a plurality of holes for receiving the heads of said printing pins.

5. A line printer for printing raised-dot language comprising:

(1) a base member having in an upper structure thereof a row of a plurality of printing pins, and means for biasing said pins so that heads of said pins protrude above a surface of said base member, and having in a lower structure thereof a plurality of latch pins and a plurality of solenoids energizable to protrude said latch pins into positions in which they prevent the printing pins from being depressed;

(2) a printing plate member for pressing a paper form against the heads of said plurality of printing pins arranged on said base member sequentially from one end to the other end thereof in the direction of arrangement of said printing pins so as to produce embossed dots on the paper form, and (3) a driving mechanism disposed to be operated from a driving source such that said printing plate member is moved like a cradle in the direction of arrangement of said printing pins, said driving mechanism comprises:

a pair of cylinder cases each thereof being formed with a vertical guide slit for guiding the sides of said printing plate member;

a pair of pistons disposed in said pair of cylinder cases and connected to the side ends of said printing plate member;

rotary crank means for slidingly moving said pistons in such a manner that one of said pistons is moved with a predetermined amount of delay with respect to the other; and means for transmitting a rotary motion from said driving source to said rotary crank means.

6. A line printer according to claim 5, wherein said printing plate member comprises a semicircular plate including a surface adapted to be pressed against said base member, said surface being in the form of a circular surface forming a part of a circumference of a circle having a predetermined radius, and coupling means provided at each side end of said plate to transmit thereto a rocking motion from said driving mechanism.

7. A line printer according to claim 6, wherein said circular surface of said semicircular plate is provided with a longitudinal groove for receiving the heads of said printing pins.

8. A line printer according to claim 6, wherein said circular surface of said semicircular plate is provided with a plurality of holes for receiving the heads of said printing pins.

* * * * *